US005435291A

United States Patent [19]

Woodward

[11] Patent Number: 5,435,291

[45] Date of Patent: Jul. 25, 1995

[54] BOWSTRING RELEASE APPARATUS

[75] Inventor: Joseph A. Woodward, Downers Grove, Ill.

[73] Assignee: Anchor Point Archery Inc., Downers Grove, Ill.

[21] Appl. No.: 229,565

[22] Filed: Apr. 19, 1994

[51] Int. Cl.[6] ..... F41B 5/18
[52] U.S. Cl. ..... 124/35.2
[58] Field of Search ..... 124/35.2

[56] References Cited

U.S. PATENT DOCUMENTS

| | | | |
|---|---|---|---|
| 4,156,417 | 5/1979 | Fletcher | 124/35.2 |
| 4,169,455 | 10/1979 | Wilson | 124/35.2 |
| 4,249,507 | 2/1981 | Marra | 124/35.2 |
| 4,308,851 | 1/1982 | Kaine et al. | 124/35.2 |
| 4,391,263 | 7/1983 | Dodge | 124/35.2 |
| 4,489,705 | 12/1984 | Larson | 124/35.2 |
| 4,625,705 | 12/1986 | Willits | 124/35.2 |
| 4,665,886 | 5/1987 | Barlow | 124/35.2 |
| 4,724,821 | 2/1988 | Besaw | 124/35.2 |
| 4,877,009 | 10/1989 | Becker | 124/35.2 |
| 5,025,772 | 6/1991 | Stevenson | 124/35.2 |
| 5,224,463 | 7/1993 | Townsend | 124/35.2 |

OTHER PUBLICATIONS

Magazine article, Scott Archery, Mfg., 587 Adams Ridge Road, Clay City, Ky. 40312.
Catalog article, Item 638-261, X-Caliper Release.
Catalog article, AIM, Dec./Jan. 1994, Pro Release Inc., 33551 Giftos, Mt. Clemens, Mich. 48035.

*Primary Examiner*—Randolph A. Reese
*Assistant Examiner*—John A. Ricci
*Attorney, Agent, or Firm*—Speckman, Pauley & Fejer

[57] ABSTRACT

A bowstring release apparatus having a housing and a release arm projecting from the housing. A flexible cord is secured with respect to the release arm and thereby forms a gap between the release arm and the flexible cord, when the bowstring release apparatus is in a loaded position. Upon release of the flexible cord with respect to the release arm, the bowstring release apparatus moves from a loaded position toward an unloaded position. A longitudinal axis of the release arm is positioned generally parallel to a direction of travel along which a bowstring moves, when the bowstring release apparatus moves from the loaded position to the unloaded position. Contact between the flexible cord and the bowstring preferably does not exceed an approximately 90° arc section of an outer circumferential surface of the bowstring.

21 Claims, 4 Drawing Sheets

BOWSTRING RELEASE APPARATUS

BACKGROUND OF THE INVENTION

1. Field of the Invention

This invention relates to a positive loading apparatus used to grasp and draw a bowstring of an archery bow and then to release the bowstring in a manner that reduces external forces acting upon the bowstring.

2. Description of Prior Art

Many conventional bowstring draw and release apparatuses use a flexible twine, string or cord to form a closed loop which is wrapped around a release rod that is positioned, when loaded, perpendicular or at a significant angle with respect to either a direction that the bowstring travels during discharge or with respect to a loaded arrow shaft. Conventional bowstring draw and release devices do not teach or even suggest wrapping a flexible cord around a release arm that is positioned generally parallel to the direction of bowstring travel.

For example, U.S. Pat. No. 4,877,009 discloses a holding arm over which a loop of flexible twine is positioned. The holding arm is perpendicular to a direction of travel of the bowstring. U.S. Pat. No. 4,665,886 teaches a trigger mechanism having a releasing latch post which is positioned approximately perpendicular to the direction of travel of the bowstring, when in a loaded position.

Other known U.S. Patents also disclose a holding arm or other similar structure which is positioned generally perpendicular or at a significant angle with respect to the direction of travel of the bowstring, during discharge of an arrow from the archery bow. As clearly illustrated in U.S. Pat. No. 4,877,009, the flexible twine, string or cord contacts approximately 180° of the circumferential surface of the bowstring, when in a loaded position. The releasing frictional forces between the flexible twine, string or cord and the bowstring is a function of the circumferential surface contact between the flexible twine and the bowstring. In order to avoid undue wear and tear on both the bowstring and the flexible twine, there is a need to reduce the amount of contact between the bowstring and the flexible twine.

SUMMARY OF THE INVENTION

It is one object of this invention to provide a bowstring release apparatus which minimizes frictional wear between the bowstring and a flexible cord of the bowstring release apparatus.

It is another object of this invention to provide a bowstring release apparatus which has a release arm over which a loop of flexible cord is positioned, wherein the release arm is positioned approximately parallel to a direction of travel of the bowstring or which is approximately parallel to an arrow shaft loaded in an archery bow.

It is another object of this invention to provide a bowstring release apparatus which has a flexible cord that contacts only approximately 90° of a circumferential outer surface of the bowstring, when the bowstring release apparatus is in a loaded position.

It is still another object of this invention to provide a bowstring release apparatus which has relatively few moving parts and which is easily manufactured at a relatively low cost.

The above and other objects of this invention are accomplished with a bowstring release apparatus which has a housing and a release arm projecting from the housing. A flexible cord is secured with respect to the release arm. In a loaded position, a gap is formed between the release arm and the flexible cord. The gap preferably accommodates a bowstring of an archery bow. The flexible cord is released with respect to the release arm when the bowstring release apparatus is triggered or moves from a loaded position toward an unloaded position. A generally defined longitudinal axis of the release arm is positioned generally parallel to a direction of travel as the bowstring is released from the loaded position.

In one preferred embodiment according to this invention, the flexible cord forms a loop and in the loaded position, the release arm is positioned through the loop. The length of the flexible cord is preferably sized to prevent the flexible cord from detaching with respect to the release arm when the bowstring release apparatus is in the loaded position.

In one preferred embodiment according to this invention, the release arm is formed as a rod which is slidably mounted within a housing bore of the housing. A release trigger is pivotally mounted with respect to the release arm. In such embodiment, the rod has a groove, preferably a circumferential groove. In the loaded position, an end portion of the release trigger is engaged within the groove and the release trigger abuts the rod in order to prevent the rod from moving with respect to both the housing and the release trigger. The release trigger preferably pivots far enough to completely remove the end portion of the release trigger from the groove, when in the unloaded position.

The rod is preferably maintained within the housing bore in both the loaded position and the unloaded position. In one preferred embodiment according to this invention, an O-ring is secured about a circumferential portion of the rod. The O-ring interferes with a shoulder of the housing, in the unloaded position, and thereby prevents the rod from completely backing out of the housing. An end cap can also be secured about an end portion of the rod, such that the end cap interferes with the housing or any other suitable structural element attached to the housing, in order to prevent the rod from moving forward, toward the bowstring, beyond the loaded position.

The release trigger is normally urged into the loaded position. Such urging force can be overcome with the release trigger to release the rod and allow it to move into the unloaded position. As the rod moves into the unloaded position, the flexible cord releases from the rod and allows the bowstring to discharge a loaded arrow shaft. In order to urge the release trigger into the loaded position, according to one preferred embodiment of this invention, a spring is mounted within a longitudinal bore within the rod. The spring has one end fixed with respect to the rod and an opposite end contacting a lock ball-bearing. The lock ball-bearing urges the pivot lever into a position which forces the release trigger into the loaded position.

In another preferred embodiment according to this invention, the release trigger is urged into the loaded position with a pivot lever that has one end pivotally mounted with respect to the rod and an opposite end pivotally mounted with respect to the release trigger. In such preferred embodiment of this invention, the release trigger has a closed bore in which a spring is mounted. A lock ball-bearing is mounted at least partially within the closed bore. The spring urges the lock ball-bearing against the rod and urges the release trigger into a positive loaded position.

A handle, preferably constructed of a flexible material, such as a strap, cord, rope or the like, is used to grip the bowstring release apparatus and draw the bowstring.

In one preferred embodiment according to this invention, the release arm has a tapered end portion. The tapered end portion facilitates a smooth release of the flexible cord from the release arm.

In another preferred embodiment according to this invention, the release arm is an integral portion of the housing. Such integral portion of the housing can also be tapered in the forward direction, which is also referred to as a release direction of the flexible cord.

The bowstring release apparatus according to this invention advantageously provides positive loading wherein once the bowstring is loaded within the apparatus and the apparatus is positively locked or set, the trigger must be engaged in order to unlock the apparatus and thus release the bowstring. The trigger, according to one preferred embodiment of this invention, is squeezed with two fingers in lieu of pulled with a finger, as in conventional release devices, which results in a smoother and more accurate release and also presents a surprise release that reduces flinching and target panic.

DESCRIPTION OF PREFERRED EMBODIMENTS

Figure 1:
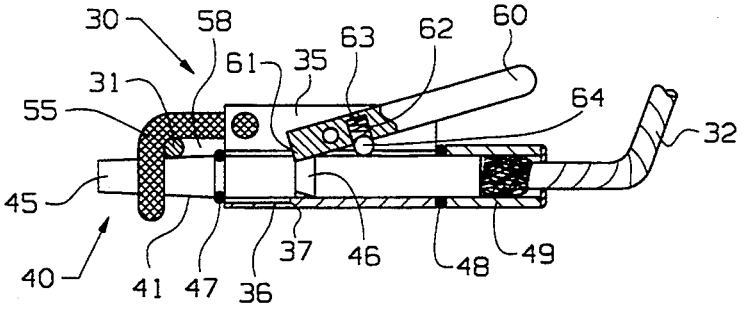
FIG. 1 is a partial cross-sectional front view of a bowstring release apparatus, according to one preferred embodiment or this invention.
Figure 3:
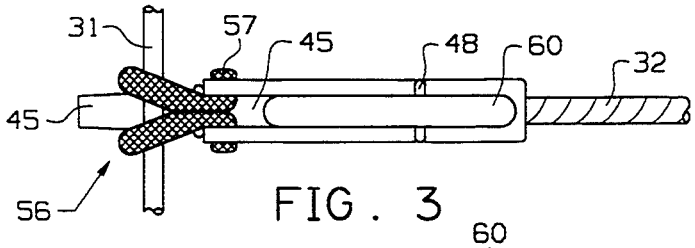
FIG. 3 is a top view of the bowstring release apparatus shown in FIG. 1.

Referring to one preferred embodiment of this invention as shown in FIGS. 1–5, bowstring release apparatus 30 comprises housing 35 and release arm 40 projecting outward from housing 35. In the preferred embodiment of this invention shown in FIGS. 1–5, release arm 40 comprises rod 45 which is slidably mounted within housing bore 36 of housing 35. Rod 45 preferably slides between two extreme positions, such as the loaded position shown in FIG. 6A and the unloaded position show in FIG. 6B.

Lock means are used to secure flexible cord 55 with respect to release arm 40. When in the loaded position as shown FIG. 6A, flexible cord 55 is wrapped around rod 45 to form gap 58 between release arm 40 and flexible cord 55, when bowstring release apparatus 30 is in the loaded position.

Figure 5:
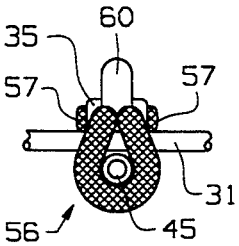
FIG. 5 is a side view of the bowstring release apparatus, viewed from the left as shown in FIG. 2.
Figure 6A:
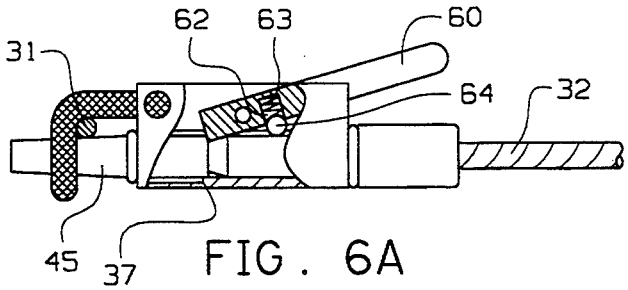
FIGS. 6A and 6B show the loaded and unloaded positions, respectively, of the bowstring release apparatus shown in FIG. 1.

In one preferred embodiment according to this invention, the lock means comprise flexible cord 55 forming loop 56, as clearly shown in FIG. 5. In the loaded position shown in FIG. 6A, rod 45 is positioned within loop 56. The length of flexible cord 55 is preferably sized and designed so that in the loaded position, such as shown in FIG. 6A, flexible cord 55 is positioned so that loop 56 cannot disengage or release from rod 45, and so that in the unloaded position a drawn bowstring 31 forces flexible cord 55 forward and thus releases loop 56 from around rod 45. As loop 56 moves forward, toward the free end of rod 45, bowstring 31 is in frictional moving contact with flexible cord 55. Thus, it is apparent that less contact surface area between bowstring 31 and flexible cord 55 results in less wear and tear and thus an extended life of both bowstring 31 and flexible cord 55. As clearly shown in FIG. 2, flexible cord 55 contacts only an approximately 90° arc section of the circumferential outer surface of bowstring 31.

Figure 2:
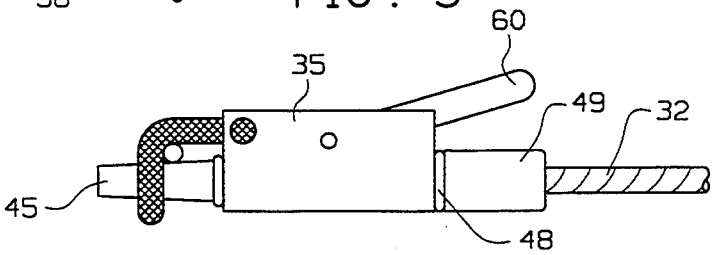
FIG. 2 is a front view of the bowstring release apparatus shown in FIG. 1.
Figure 4:
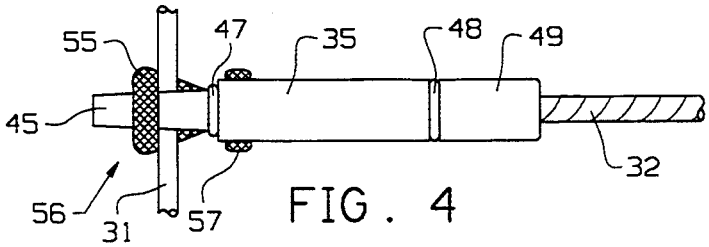
FIG. 4 is a bottom view of the bowstring release apparatus shown in FIG. 1.

As shown in FIG. 2, flexible cord 55 is wrapped around the forward portion of rod 45 such that at least a portion of loop 56 contacting rod 45 is positioned forward of bowstring 31. As used throughout this specification and in the claims, the term "forward" is intended to relate to a direction pointing toward the free end of rod 45, shown to the left in FIG. 2. By having flexible cord 55 forward of bowstring 31, it is apparent that the surface contact between bowstring 31 and flexible cord 55 can be reduced to an approximately 90° arc section of the circumference of bowstring 31. Such reduced contact surface area is possible since bowstring 31 actually contacts rod 45. The coefficient of friction between bowstring 31 and rod 45 is significantly less than the coefficient of friction between bowstring 31 and flexible cord 55. The position of rod 45 with respect to the direction of travel of bowstring 31 is an important aspect of this invention which results in significantly less wear and tear on both bowstring 31 and flexible cord 55 according to this invention. The reduced contact between bowstring 31 and flexible cord 55, according to this invention, also results in increased shooting accuracy, since fewer undesirable external forces from flexible cord 55 act upon bowstring 31.

Figure 6B:
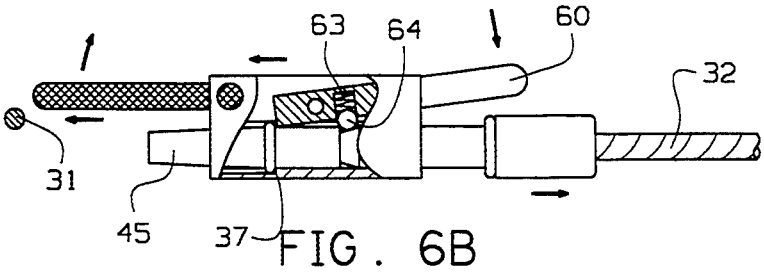
Figure 8:
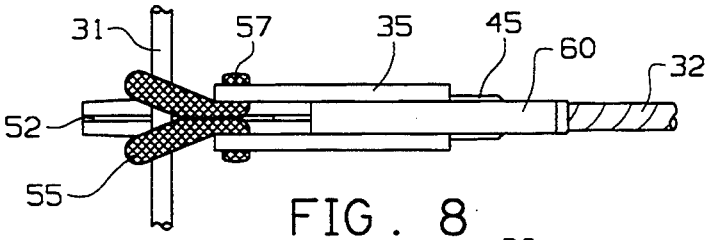
FIG. 8 is a top view of the bowstring release apparatus shown in FIG. 7.

When bowstring release apparatus 30 moves from the loaded position shown in FIG. 6A to the unloaded position shown in FIG. 6B, release means allow flexible cord 55 to disengage from or release with respect to release arm 40 or rod 45. In one preferred embodiment of this invention, release means may comprise rod 45 having groove 46. As shown in FIGS. 1, 6A and 6B, groove 46 is a circumferential groove. However, it is apparent that groove 46 can be a longitudinal groove or any other suitable groove which engages with end portion 61 of release trigger 60, when bowstring release apparatus 30 is in the loaded position. When engaged within groove 46, end portion 61 abuts rod 45, as clearly shown in FIGS. 1 and 6A, and thus locks the position of rod 45 with respect to both housing 35 and release trigger 60. Release trigger 60 preferably pivots far enough to completely remove end portion 61 from groove 46, when in the unloaded position.

Stop means are used to maintain rod 45 within housing bore 36 in both the loaded position and the unloaded position of bowstring release apparatus 30. According to one preferred embodiment of this invention, as shown in FIG. 1, such stop means comprise O-ring 47 secured about a circumferential portion of rod 45. As shown in FIG. 1, O-ring 47 fits within a circumferential groove and thereby secures O-ring 47 with respect to rod 45. As shown in FIG. 6B, O-ring 47 interferes with shoulder 37 formed by housing 35 but it is apparent that O-ring 47 can also interfere with end portion 61 of release trigger 60, either of which prevents rod 45 from moving any further backward, as shown by the directional arrow in FIG. 6B. It is also apparent that rod 45 can have a suitably sized shoulder, in lieu of O-ring 47, to accomplish the same interference result. Thus, the stop means prevents rod 45 from retracting or backing entirely out of housing 35. The stop means may also comprise end cap 49 secured about or to the end portion of rod 45, as shown in FIG. 1. In the loaded position shown in FIG. 6A, O-ring 48, which is between end cap 49 and housing 35, interferes either directly or indirectly with housing 35 to prevent rod 45 from moving beyond the loaded position shown in FIG. 6A.

Figure 10:
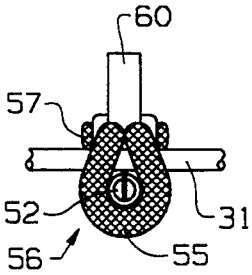
FIG. 10 is a side view of the bowstring release apparatus, viewed from the left as shown in FIG. 7.
Figure 7:
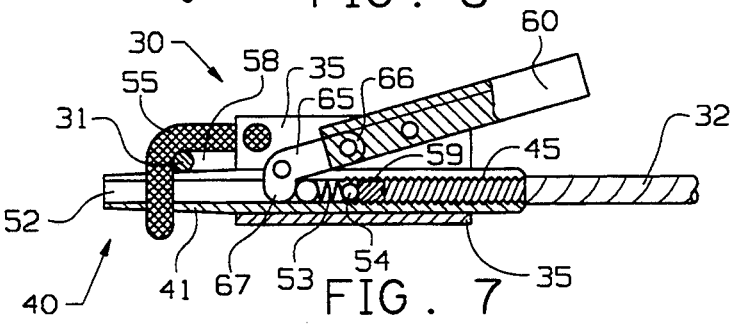
FIG. 7 is a partial cross-sectional front view of a bowstring release apparatus, according to another preferred embodiment of this invention.
Figure 9:
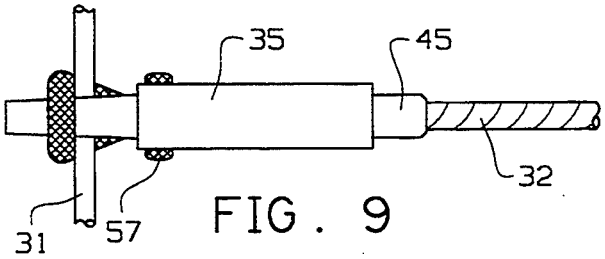
FIG. 9 is a bottom view of the bowstring release apparatus shown in FIG. 7.
Figure 11A:
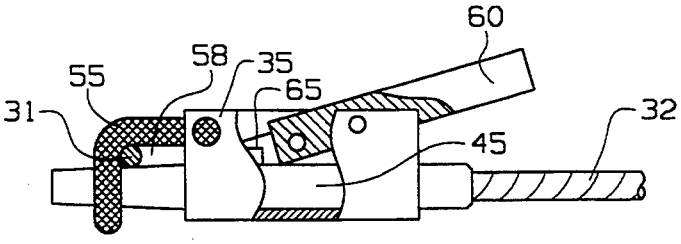
FIGS. 11A–11C show the bowstring release apparatus of FIG. 7 moving from a loaded position shown in FIG. 11A to an unloaded position shown in FIG. 11C.
Figure 11B:
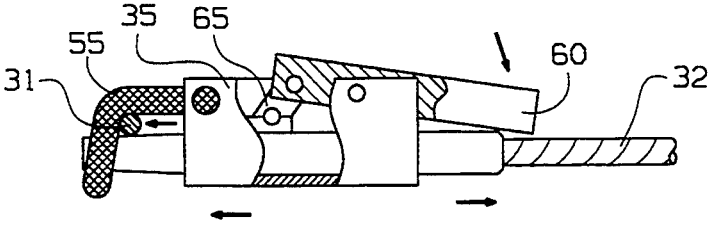
Figure 11C:
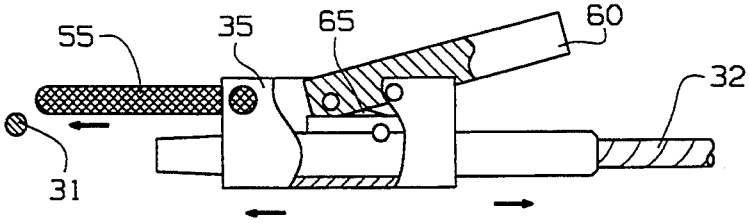
Figure 13:
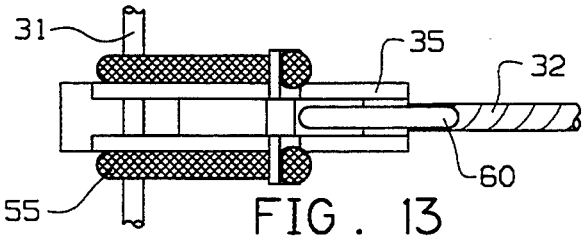
FIG. 13 is a top view of the bowstring release apparatus shown in FIG. 12.
Figure 15:
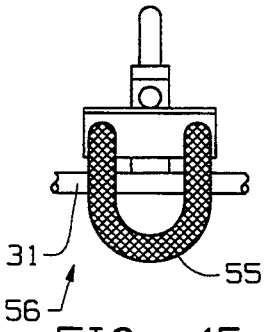
FIG. 15 is a side view of the bowstring release apparatus, viewed from the left as shown in FIG. 12.

Bias means are used to urge release trigger 60 into a loaded position, as shown in FIGS. 1 and 6A. According to one preferred embodiment of this invention, such bias means comprise spring 63 mounted within closed bore 62 of release trigger 60. Lock ball-bearing 64 is mounted at least partially within closed bore 62. Spring 63 urges lock ball-bearing 64 against rod 45, and thus urges releases trigger into a normally loaded position. In another preferred embodiment according to this invention, as shown in FIGS. 7, 9 and 10, the bias means comprise spring 53 mounted within longitudinal bore 52 of rod 45. Pivot lever 65 has end 66 pivotally mounted with respect to release trigger 60 and opposite end 67 pivotally mounted with respect to rod 45. Spring 53 has one end fixed with respect to rod 45 and an opposite end contacting lock ball-bearing 54. As shown in FIG. 7, the end of spring 53 opposite lock ball-bearing 54 abuts set screw 59, which could be threadedly mounted within longitudinal bore 52 of rod 45. Set screw 59 can be used to adjust the tension of spring 53 and thus the sensitivity of release trigger 60. Spring 53 urges lock ball-bearing 54 which contacts and forces pivot lever 65 into a position that forces release trigger 60 into the loaded position shown in FIGS. 7 and 11A. It is apparent that other suitable spring and lock ball-bearing arrangements can be used to accomplish the same result of locking release trigger 60 into a loaded position.

Draw means are used to pull or move the entire bowstring release apparatus 30 when it is in a loaded position. With bowstring 31 engaged within gap 58, such pulling or drawing motion allows an archer to set a bow. When the bow is drawn and an arrow shaft is loaded within the bow, a general longitudinal axis of release arm 40 or rod 45 is generally parallel to the arrow shaft. As used throughout this specification and in the claims, the phrase "generally parallel" is intended to relate to a general position of release arm 40 or rod 45 with respect to either a loaded arrow shaft or a direction of movement of bowstring 31, and is intended to take into account any tolerances caused by misalignment of either bowstring release apparatus 30, bowstring 31, rod 45 or the arrow shaft.

The draw means may comprise handle means for gripping, for example with a human hand. Such handle means is preferably secured with respect to rod 45 or release arm 40 when in the loaded position. As shown in FIG. 1, rope 32 is secured within end cap 49 by having a flared end portion. However, it is apparent that rope 32 or any other suitable handle can be secured directly or indirectly to rod 45 or release arm 40. For example a wrist strap can be attached to an opposite end of rope 32.

As shown in FIGS. 1–11C, rod 45 is slidably mounted within housing bore 46 and thus moves with respect to housing 35, between the loaded position and the unloaded position. The preferred embodiments of this invention shown in FIGS. 12–21C do not comprise rod 45 or another shaft which moves with respect to housing 35. In such preferred embodiments of this invention, release arm 40 is an integral portion of housing 35. However, it is apparent that release arm 40 can be a separate component secured with respect to housing 35 in any suitable manner known to those skilled in the art.

Figure 12:
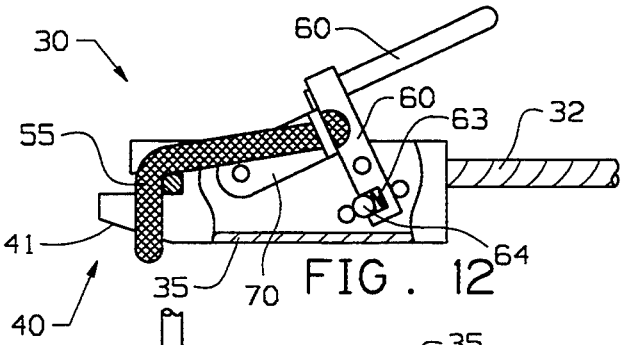
FIG. 12 is a partial cross-sectional front view of a bowstring release apparatus, according to another preferred embodiment of this invention.
Figure 14:
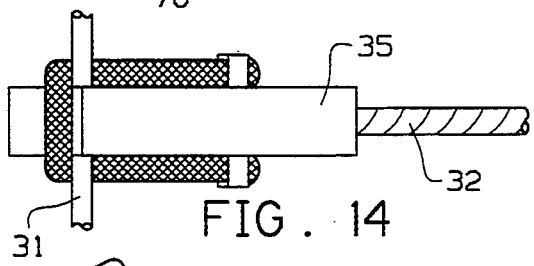
FIG. 14 is a bottom view of the bowstring release apparatus shown in FIG. 12.
Figure 17:
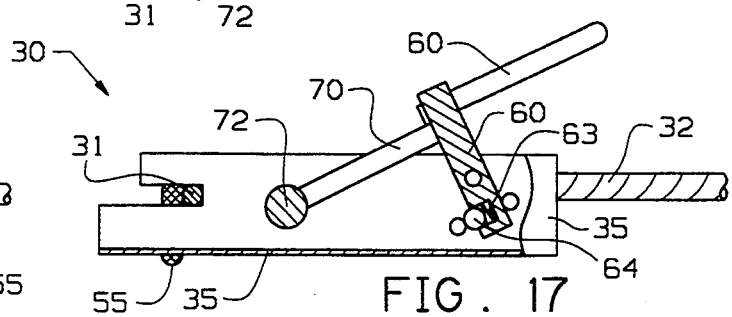
FIG. 17 is a partial cross-sectional front view of a bowstring release apparatus, according to another preferred embodiment of this invention.
Figure 19:
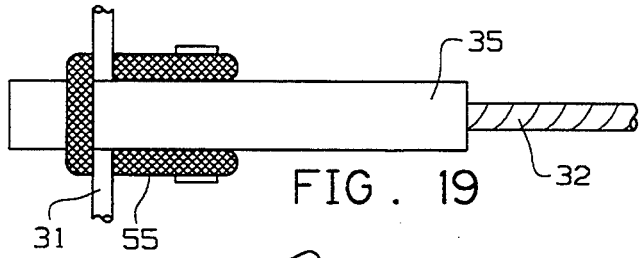
FIG. 19 is a bottom view of the bowstring release apparatus shown in FIG. 1.
Figure 21A:
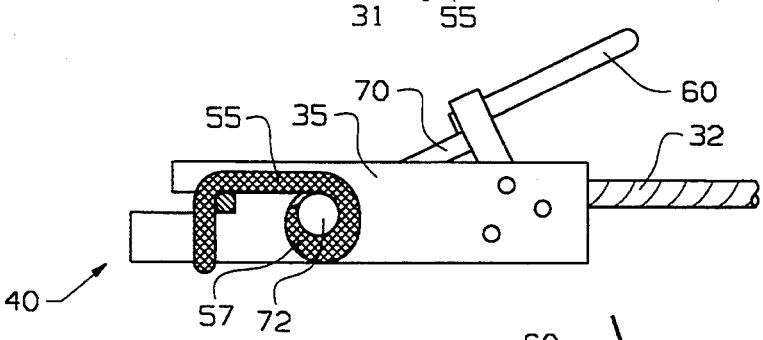
FIGS. 21A–21C show the bowstring release apparatus of FIG. 17 moving from a loaded position shown in FIG. 21A to an unloaded position shown in FIG. 21C.
Figure 21B:
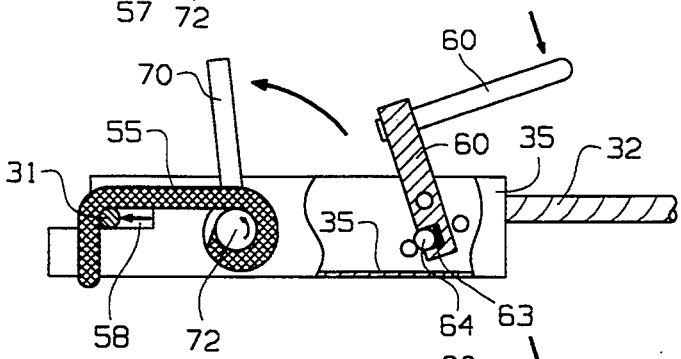
Figure 21C:
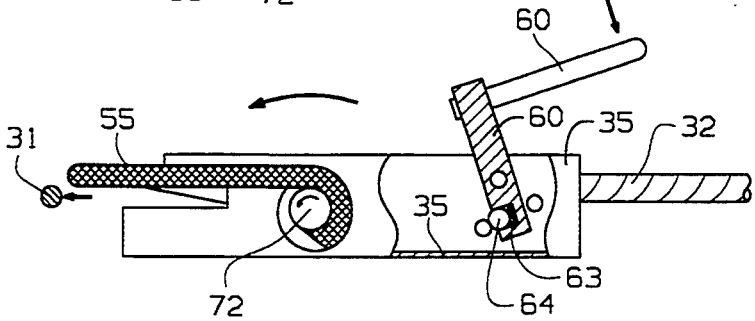

As clearly shown in FIGS. 1, 7 and 12, rod 45 or release arm 40 can have tapered end portion 41, which tapers toward the forward direction of release of flexible cord 55. Tapered end portion 41 enhances the release motion of flexible cord 55. It is apparent that other suitably shaped end portions having various curves or straight sections can be used to facilitate the release motion of flexible cord 55. It is also apparent that the preferred embodiments of this invention shown in FIGS. 1–11C can have non-tapered front portions, such as shown in FIG. 17.

As shown in the preferred embodiments of FIGS. 12–15, a slightly different triggering mechanism is used wherein flexible cord 55 is not fixed with respect to housing 35 but rather is fixed with respect to pivot arm 70, which is pivotally mounted with respect to housing 35. The spring and lock ball-bearing arrangement shown in FIGS. 12 and 16A–16C can be used to accomplish the same result of securing flexible cord 55 with respect to release arm 40, when bowstring release apparatus 30 is in a loaded position.

Figure 16A:
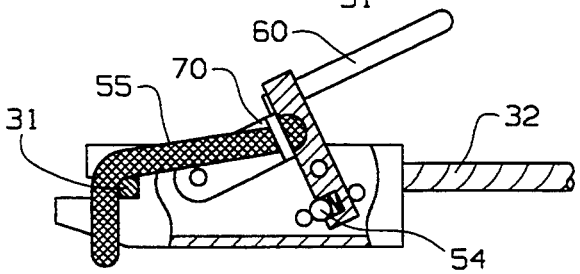
FIGS. 16A–16C show the bowstring release apparatus of FIG. 12 moving from a loaded position shown in FIG. 16A to an unloaded position shown in FIG. 16C.
Figure 16B:
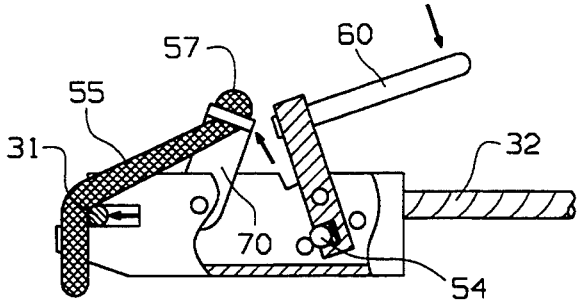
Figure 16C:
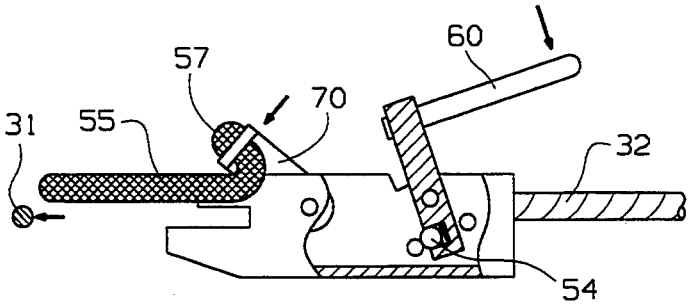
Figure 18:
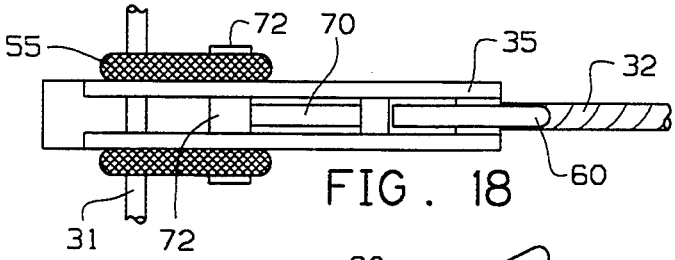
FIG. 18 is a top view of the bowstring release apparatus shown FIG. 1.
Figure 20:
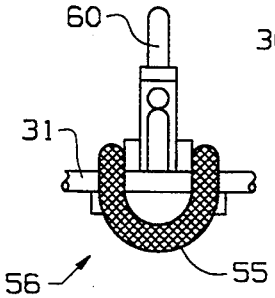
FIG. 20 is a side view of the bowstring release apparatus, viewed from the left as shown in FIG. 17.

FIGS. 16A–16C show the relative motion of bowstring release apparatus 30, according to such preferred embodiment. In the loaded position shown in FIG. 16A, bowstring 31 is mounted within gap 58. As release trigger 60 pivots away from pivot arm 70, the force exerted by bowstring 31 moves flexible cord 55 forward and thus pulls pivot arm 70 in a forward direction. As shown in FIG. 16C, the force exerted by bowstring 31 is so great that it completely forces flexible cord 55 away and bowstring 31 then completes its discharge motion. According to the preferred embodiments shown in FIGS. 17–21C, flexible cord 55 has both end portions 57 attached to pivot shaft 72. Pivot shaft 72 is preferably rotatably mounted with respect to housing 35. In one preferred embodiment according to this invention, pivot shaft 72 is spring-loaded for return-coiling of flexible cord 55. Such spring-loading is preferred but not necessary.

As shown in the preferred embodiments of FIGS. 12–21C, latch means are used to releasably lock pivot arm 70 with respect to housing 35, when bowstring release apparatus 30 is in the locked position. Such latch means comprise pivot arm 70 and release trigger 60.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A bowstring release apparatus comprising:

a housing, a release arm projecting from said housing;

a flexible cord; lock means for securing said flexible cord with respect to said release arm and forming a gap between said release arm and said flexible cord when the bowstring release apparatus is in a loaded position;

release means for allowing said flexible cord to release with respect to said release arm when the bowstring release apparatus moves from said loaded position toward an unloaded position; and a longitudinal axis of said release arm fixed generally parallel to a direction of travel along which a bowstring mounted within said gap moves when the bowstring release apparatus moves from said loaded position to said unloaded position.

2. A bowstring release apparatus according to claim 1 wherein said lock means comprise said flexible cord forming a loop, and in said loaded position said release arm positioned within said loop.

3. A bowstring release apparatus according to claim 2 wherein in said loaded position a length of said flexible cord is sized to prevent said flexible cord from detaching with respect to said release arm.

4. A bowstring release apparatus according to claim 1 wherein said lock means comprise a release trigger pivotally mounted with respect to said release arm.

5. A bowstring release apparatus according to claim 4 wherein said release arm is a rod, said housing has a housing bore, and said rod is slidably mounted within said housing bore.

6. A bowstring release apparatus according to claim 5 wherein said rod has a groove, and in said loaded position an end portion of said release trigger is engaged within said groove.

7. A bowstring release apparatus according to claim 6 wherein said release means comprise said release trigger pivoting far enough to remove said end portion from said groove when in said unloaded position.

8. A bowstring release apparatus according to claim 5 further comprising stop means for maintaining said rod within said housing bore in said loaded position and said unloaded position.

9. A bowstring release apparatus according to claim 8 wherein said stop means comprise an O-ring secured about a circumferential portion of said rod, and said O-ring interfering with a shoulder formed by said housing.

10. A bowstring release apparatus according to claim 8 wherein said stop means comprise an end cap secured about an end portion of said rod, and said end cap positioned to interfere with respect to said housing to prevent said rod from moving beyond said loaded position.

11. A bowstring release apparatus according to claim 5 further comprising bias means for urging said release trigger into said loaded position.

12. A bowstring release apparatus according to claim 11 wherein said release means overcomes a bias force of said bias means and allows said rod to move into said unloaded position.

13. A bowstring release apparatus according to claim 11 further comprising a pivot lever, said pivot lever having one end pivotally mounted with respect to said rod and an opposite end pivotally mounted with respect to said release trigger.

14. A bowstring release apparatus according to claim 13 wherein said bias means comprise a spring mounted within a longitudinal bore within said rod, said spring having one end fixed with respect to said rod and an opposite end contacting a lock ball-bearing, and said lock ball-bearing urging said pivot lever into a position which forces said release trigger into said loaded position.

15. A bowstring release apparatus according to claim 11 wherein said bias means comprise said release trigger having a closed bore, a spring mounted within said closed bore, a lock ball-bearing mounted at least partially within said closed bore, and said spring urging said lock ball-bearing against said rod.

16. A bowstring release apparatus according to claim 1 further comprising draw means for moving the bowstring release apparatus when in a loaded position.

17. A bowstring release apparatus according to claim 16 wherein said draw means comprise handle means for gripping the draw means, and said handle means secured with respect to said rod when in said loaded position.

18. A bowstring release apparatus according to claim 1 wherein said release arm has a tapered end portion.

19. A bowstring release apparatus according to claim 1 wherein said release arm is an integral portion of said housing.

20. A bowstring release apparatus according to claim 19 further comprising a pivot arm pivotally mounted with respect to said housing, an end portion of said flexible cord secured to said pivot arm, and latch means for releasably locking said pivot arm with respect to said housing when the bowstring release apparatus is in said locked position.

21. In a bowstring release apparatus having a release arm, a loop of flexible cord positioned over the release arm in a loaded position forming a gap large enough to accommodate a bowstring between the release arm and the flexible cord, wherein the loop of flexible cord is released from the release arm in an unloaded position, the improvement comprising: means for limiting contact between the flexible cord and the bowstring to an approximately 90° arc section of an outer circumferential surface of the bowstring, when in the loaded position.

* * * * *